US006134333A

United States Patent [19]

Flagler

[11] Patent Number: 6,134,333

[45] Date of Patent: Oct. 17, 2000

[54] DISPOSABLE OLEOPHOBIC AND HYDROPHOBIC BARRIER FOR A HEARING AID

[75] Inventor: Robert W. Flagler, Pleasanton, Calif.

[73] Assignee: Sonic Innovations, Inc., Salt Lake City, Utah

[21] Appl. No.: 09/040,500

[22] Filed: Mar. 17, 1998

[51] Int. Cl.[7] ..... H04R 25/00

[52] U.S. Cl. ..... 381/325; 381/328; 181/130

[58] Field of Search ..... 381/325, 328, 381/322, 324, FOR 133; 181/129, 130, 135; 128/864

[56] References Cited

U.S. PATENT DOCUMENTS

| | | | |
|---|---|---|---|
| D. 355,702 | 2/1995 | Johnson | D23/209 |
| 3,197,577 | 7/1965 | Kuklock | 179/184 |
| 3,415,246 | 12/1968 | Hill | 128/152 |
| 3,457,375 | 7/1969 | Haggerty | 179/107 |
| 3,598,928 | 8/1971 | Hickox | 179/107 |
| 3,872,559 | 3/1975 | Leight | 128/152 |
| 3,881,570 | 5/1975 | Lewis | 181/135 |
| 3,976,848 | 8/1976 | Estes | 179/107 |
| 4,160,449 | 7/1979 | Wade | 128/152 |
| 4,193,396 | 3/1980 | Wacker | 128/152 |
| 4,253,452 | 3/1981 | Powers et al. | 128/152 |
| 4,293,355 | 10/1981 | Wacker | 156/73.2 |
| 4,434,794 | 3/1984 | Leight | 128/152 |
| 4,440,982 | 4/1984 | Kaanders et al. | 179/107 R |
| 4,553,627 | 11/1985 | Gastmeier et al. | 181/135 |
| 4,582,053 | 4/1986 | Wilson | 128/152 |
| 4,774,938 | 10/1988 | Leight | 128/864 |
| 4,800,982 | 1/1989 | Carlson | 181/130 |
| 4,870,689 | 9/1989 | Weiss | 381/68.6 |
| 4,879,750 | 11/1989 | Nassler | 381/68.6 |
| 4,937,876 | 6/1990 | Biermans | 381/68.6 |
| 4,945,569 | 7/1990 | Kulman | 381/68.6 |
| 4,953,215 | 8/1990 | Weiss et al. | 381/68 |
| 4,972,488 | 11/1990 | Weiss et al. | 381/68.6 |
| 4,987,597 | 1/1991 | Haertl | 381/325 |
| 5,074,375 | 12/1991 | Grozil | 181/135 |
| 5,099,947 | 3/1992 | Guggenberger et al. | 181/130 |
| 5,105,904 | 4/1992 | Olsen | 181/128 |
| 5,113,967 | 5/1992 | Killion et al. | 181/132 |
| 5,131,128 | 7/1992 | Bisgaard et al. | 29/239 |
| 5,133,016 | 7/1992 | Clark | 381/69.2 |
| 5,166,659 | 11/1992 | Navarro | 381/68.6 |
| 5,188,123 | 2/1993 | Gardner, Jr. | 128/864 |
| 5,203,352 | 4/1993 | Gardner, Jr. | 128/864 |
| 5,278,360 | 1/1994 | Carbe et al. | 181/135 |
| 5,293,008 | 3/1994 | Danielson | 181/135 |
| 5,319,163 | 6/1994 | Scott | 181/130 |
| 5,327,500 | 7/1994 | Campbell | 381/68.6 |
| 5,401,920 | 3/1995 | Oliveira | 181/135 |
| 5,452,731 | 9/1995 | Dickman | 128/864 |
| 5,488,961 | 2/1996 | Adams et al. | 128/864 |
| 5,530,763 | 6/1996 | Aebi et al. | 381/69 |
| 5,535,282 | 7/1996 | Luca | 381/68.6 |

*Primary Examiner*—Huyen Le
*Attorney, Agent, or Firm*—D'Alessandro & Ritchie

[57] ABSTRACT

A cerumen barrier removable from a retaining ring in a hearing aid shell comprises an endcap disposed in the retaining ring, wherein the endcap has a sound passage with a first opening and a second opening, and the first opening is positioned above a sound tube and the second opening is covered by an oleophobic and hydrophobic screen.

13 Claims, 1 Drawing Sheet

DISPOSABLE OLEOPHOBIC AND HYDROPHOBIC BARRIER FOR A HEARING AID

BACKGROUND OF THE INVENTION

1. Field Of The Invention

The present invention relates to barriers for hearing aids. More particularly, the present invention relates to a disposable membrane cerumen and moisture barrier with a low acoustic impedance.

2. The Prior Art

With the vast improvement in integrated circuit technologies and signal processing capabilities in recent years, the focus of hearing aid technologies has shifted from a behind-the-ear hearing aid resting on the visible external ear to an in-the-ear hearing aid that is inserted almost entirely into the ear canal. In a typical in-the-ear hearing aid, a microphone disposed within the hearing aid shell and adjacent to an input sound port receives an acoustic signal and transduces the acoustic signal into an electrical signal. The electrical signal is processed, and the processed signal is output to an electro-acoustic output transducer that converts the processed electrical signal to an acoustic signal. A sound passage tube connected to the output transducer passes the acoustic signal through a sound outlet port in the tip of the hearing aid shell. The sound outlet port is usually proximal to the ear drum of the hearing aid user, and is positioned approximately mid-canal.

An ear canal into which an in-the-ear hearing aid is disposed has a bent shape and consists essentially of two portions. The first portion is closest to the external ear and extends typically a little over a centimeter into the ear canal, has soft tissue between the skin and the underlying bone to form a padded area, and has tiny hairlike projections. Cerumen or wax is produced in this portion of the ear canal. The second portion is closest to the ear drum and comprises skin over bone, with little soft tissue to offer padding between the skin and bone. Because of the lack of padding in the second portion, the skin in the second portion is quite sensitive to any foreign body that is placed against it. As such, in-the-ear hearing aids are typically placed such that the portion of the hearing aid pressing against the hearing canal does not extend further than the first portion of the ear canal.

Unfortunately, the cerumen which is produced in the first portion of the ear canal can then more readily cause problems with the operation of the hearing aid. There are at least two problems well known to those of ordinary skill in the art that cerumen can cause. First, is a clogging of the outlet sound port which reduces sound transmission from the hearing aid to the hearing aid user. Second is cerumen travelling down the sound tube to impair, disable or ruin the electro-acoustic transducer. As a result, a wide variety of apparatus have been proposed in the prior art that act as a barrier between the cerumen and the sound tube.

In the examples of the various cerumen barriers given below, the ease of cleaning and replacement, frequency of cleaning and replacement, and acoustic attenuation are just a few of the design issues that were contemplated. The various cerumen barriers include complex mechanical arrangements that form a difficult or tortuous path for cerumen to travel along to get to the sound outlet port, a filter, a torturous path in combination with a filter, grooves or areas in the barrier designed to collect cerumen, etc.

As examples of a tortuous path cerumen barrier, U.S. Pat. No. 4,870,689 describes a housing that is positioned within the tip of the hearing aid and has a plurality of projections within the substantially cylindrical housing to impede and accumulate cerumen entering the housing, and U.S. Pat. No. 5,105,904 describes the combination of a component and a cap, wherein the component is insertable into the tip of a hearing aid and has a number of circumferentially spaced angle brackets and radially projecting bracket locking detents and a cap that fits over the angle brackets and onto the locking detents.

As an example of a filter, U.S. Pat. No. 5,401,920 describes a cerumen barrier which comprises a thin flexible membrane one surface of which has a pressure sensitive adhesive layer so that the membrane may be affixed to the tip of the hearing aid. And as examples of a tortuous path combined with a filter U.S. Pat. No. 4,553,627 describes a cerumen barrier having a stem portion and a head portion, wherein the stem portion is inserted into the tip of the hearing aid and has an axial tube with an acoustic filter disposed therein and which communicates with a cross passage which extends through the head portion, and U.S. Pat. No. 4,972,488 describes a housing that is positioned within the tip of the hearing aid and has a plurality of projections within the substantially cylindrical housing to impede and accumulate cerumen entering the housing, and a screen to further impede and accumulate cerumen.

As examples of cerumen barriers that have specific places designed to accumulate cerumen, U.S. Pat. No. 4,953,215 describes a non-porous membrane which covers an electro-acoustics transducer which projects into a sound conducting channel, wherein the non-porous membrane has a bore that communicates with the channel, and U.S. Pat. No. 4,879,750 discloses a perforated cap which is secured to a protrusion on the tip of the hearing aid and has a substantially flat end plate adjacent to the protrusion which bears a groove for collecting cerumen.

As further examples of cerumen barriers, U.S. Pat. No. 4,945,569 describes a tube section which projects beyond the tip of the hearing aid and further has a yoke formed over the tube of the tube extending from the tip of the hearing aid. U.S. Pat. No. 5,099,947 describes a cerumen guard which is formed as a coil of wire cone that is interference fitted into the receiver of a hearing aid. U.S. Pat. No. 5,278,360 describes a cerumen trap which has a body that is inserted into and affixed to the tip of a hearing aid shell and which communicates with the sound tube and a bridge that is formed integrally with the body and extending over the opening in the body, wherein the bridge includes both a bar and a shielding member. U.S. Pat. No. 5,293,008 discloses a cerumen trap which includes a piston or plug shaped member for pushing cerumen out of the cerumen trap. And U.S. Pat. No. 5,327,500 describes a sound outlet base and a barrier door, wherein the sound outlet base is inserted and secured into the sound outlet port of the hearing aid shell and the barrier door is inserted into the counterbore of the sound outlet base.

Though each of these cerumen barrier designs to some degree address one or all of the design issues set forth above and other design issues as well, their exists the need for a cerumen barrier that prevents cerumen and moisture from entering the sound outlet passage, may be easily replaced, and provides a desired acoustic response.

BRIEF DESCRIPTION OF THE INVENTION

According to the present invention, a cerumen barrier removable from a retaining ring adhered above a sound tube in a hearing aid shell comprises an endcap disposed in the retaining ring, wherein the endcap has a sound passage with a first opening and a second opening, and the first opening is positioned above a sound tube and the second opening is covered by an oleophobic and hydrophobic screen.

DETAILED DESCRIPTION OF A PREFERRED EMBODIMENT

Those of ordinary skill in the art will realize that the following description of the present invention is illustrative only and not in any way limiting. Other embodiments of the invention will readily suggest themselves to such skilled persons.

Figure 1:
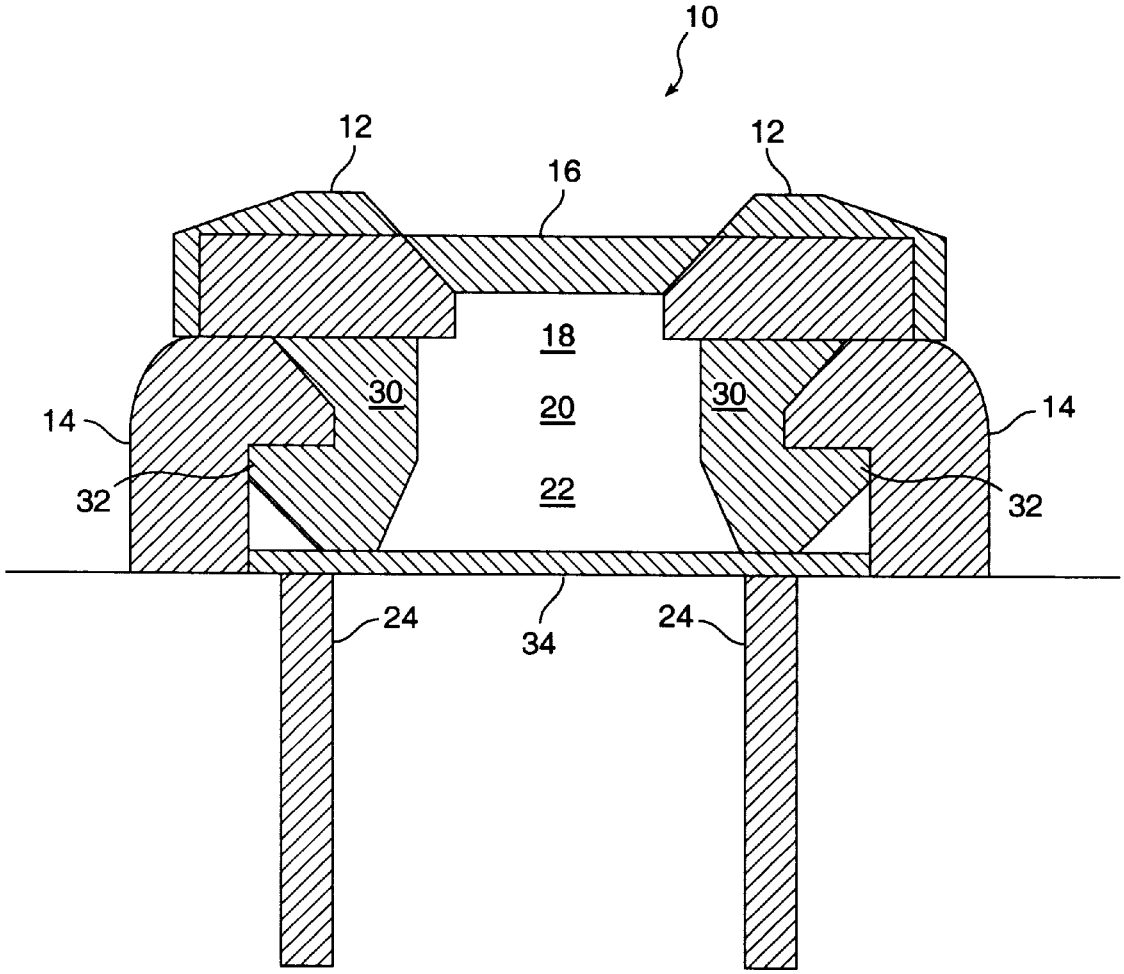
FIG. 1. illustrates in cross-section a cerumen and moisture barrier according to the present invention.
Figure 2:
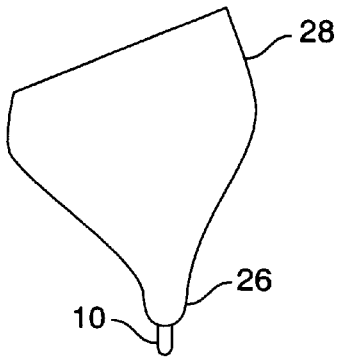
FIG. 2 illustrates an in-the-ear hearing aid with a cerumen and moisture barrier disposed therein according to the present invention.

According to the present invention, a dual screen and membrane cerumen barrier 10 is depicted in cross section in FIG. 1. The cerumen barrier 10 comprises a deformable sound passage endcap 12 formed out of silicone and fastened by a retaining ring 14, a membrane 16 covering a first opening 18 in the deformable sound passage endcap 12. The sound passage endcap 12 has a sound passage 20 with a second opening 22 covered by a screen 34. The second opening 22 is disposed above a sound passage tube 24 in the hearing aid shell 28 (FIG. 2). According to the present invention, membrane 16 provides a barrier to cerumen and to liquids. As illustrated in FIG. 2, the cerumen barrier 10 is disposed in the tip 26 of a hearing aid shell 28. It should be appreciated that the hearing aid shell 28 and the cerumen barrier 10 in FIG. 2 are not illustrated in exact scale. The cerumen barrier 10 disposed in the tip 22 of the hearing aid shell 28 impedes the flow of cerumen and liquid into the sound tube 24.

As is well understood by multitudes of hearing aid users, and those of ordinary skill in the art, the process of keeping the sound tube of a hearing aid free from cerumen and other debris is a nearly continuous exercise. Unlike many prior art devices, which require that the cerumen barrier be cleaned to keep the sound tube free of debris, the deformable sound passage endcap 12 according to the present invention may be easily fitted into the retaining ring 14 of the cerumen barrier 10, and then pulled out and disposed of when the wax build-up on the membrane 16 becomes too great.

The deformable sound passage endcap 12 in the preferred embodiment is formed from silicone. It will appreciated, however, by those of ordinary skill in the art that the deformable sound passage endcap 12 could be formed from other elastomeric materials. The shape of the deformable sound passage endcap 12 is somewhat cylindrical. The passage 20 formed by the inner portion of wall 30 of the deformable sound passage endcap 12 is essentially uniform in diameter, and in the preferred embodiment, the first opening 18 is about 0.078 inches in diameter, the second opening 22 is about 0.071 inches in diameter, and the sound passage 20 is about 0.051 inches in diameter. The outer portion of wall 30 has a tapered undercut leading to a ring shaped cutout in the middle section. The ring shaped cutout is shaped to mate with the shape of retaining ring 14 to form a locking detent.

According to the present invention, the deformable sound passage end cap 12 may be fitted into the tip 26 of the hearing aid shell 28 by simply pressing the deformable sound passage end cap 12 past the retaining ring 14. As the deformable sound passage end cap 12 is pushed past the retaining ring 14, the wall 30 deforms and is forced inward. Once a lip 32 formed by the bottom of the ring shaped cutout in the outer portion of the wall 30 slides past the lower edge of the retaining ring 14, the wall 30 moves radially outward to return to its original shape. The outer portion of the wall 30 which has been shaped to follow the contour of the retaining ring 14 presses against the retaining ring 14 to apply and maintain a mechanical force.

To provide the opening into which the cerumen barrier 10 is disposed, the retaining ring 14 is preferably adhesive bonded to the cerumen barrier and the tip 26 of the hearing aid shell 28. Other apparatus suitable for fastening the sound passage endcap 12 to the tip 26 of the hearing aid shell 28 will be appreciated by those of ordinary skill in the art.

According to the present invention, the membrane 16 covering the deformable sound passage end cap 12 he sound passage endcap is preferably a non-woven polyester material manufactured by W. L. Gore & Associates, Inc., Elkton, Md., with the trade name ALL-WEATHER™. Membrane 16 has advantageous physical properties that permit good sound transmission, and further, is both hydrophobic and oleophobic. Membrane 16 is also classified as a technical vent that provides pressure equalization. The operation of the vent to perform pressure equalization is critical in maintaining transducer diaphragm integrity. The known uses of the material from which membrane 16 is formed include that of microphones, pressure valves and speaker covers. The maximum acoustic attenuation for both composite and pure tones occurring due to the action of the membrane 20 is from about 1 to about 1.5 dB from 1000 hz to 6000 hz. It should be appreciated, that other materials known to those of ordinary skill in the art may be used to provide the functional characteristics of the vent 16.

From FIG. 1 it can be understood that the sound transmission path includes the sound tube 24, the sound passage 20, and the membrane 16. For cerumen or liquid to enter the sound tube 24 by the sound transmission path it must pass through the membrane 16. Cerumen or liquid will not likely pass through membrane 16 due to its anisometric pore structure, and it is further unlikely that cerumen or liquid will adhere to membrane 16 because it is both hydrophobic and oleophobic.

While embodiments and applications of this invention have been shown and described, it would be apparent to those skilled in the art that many more modifications than mentioned above are possible without departing from the inventive concepts herein. The invention, therefore, is not to be restricted except in the spirit of the appended claims.

What is claimed is:

1. A hearing aid for insertion into an ear, said hearing aid comprising:

a shell enclosing the hearing aid, said shell including a tip region having a sound port, said sound port penetrating said shell;

a cerumen barrier assembly including a flat membrane, a screen and an end cap, said end cap fastened by a retaining ring and disposed over a sound passage tube, said retaining ring disposed in said tip region and adhesively fastened to said cerumen barrier and to said tip of said hearing aid shell; and a sound tube connecting said sound port with an internal portion of the hearing aid.

2. A hearing aid according to claim 1, wherein said end cap is roughly cylindrical in shape.

3. A hearing aid according to claim 1, wherein said end cap is deformable and formed of silicone.

4. A hearing aid according to claim 1, wherein said end cap has a wall, the outer portion of said wall having a tapered undercut.

5. A hearing aid according to claim 4, wherein the tapered undercut of the end cap leads to a ring shaped cutout in the middle section.

6. A hearing aid according to claim 5, wherein the ring shaped tapered undercut of the end cap mates with the shape of the retaining ring to form a locking detent.

7. A hearing aid according to claim 1, wherein said end cap comprises two openings.

8. A hearing aid according to claim 7, wherein one of said openings is covered by the membrane.

9. A hearing aid according to claim 8, wherein said membrane has an anisometric pore structure to act as a vent.

10. A hearing aid according to claim 8, wherein said vent provides pressure equalization to maintain transducer diaphragm integrity.

11. A hearing aid according to claim 8, wherein said membrane is disposable and has oleophobic properties.

12. A hearing aid according to claim 8, wherein said membrane is made with non woven polyester.

13. A hearing aid according to claim 7, wherein one of said openings is covered by the screen.

* * * * *

UNITED STATES PATENT AND TRADEMARK OFFICE

CERTIFICATE OF CORRECTION

PATENT NO. : 6,134,333
DATED : October 17, 2000
INVENTOR(S) : Robert W. Flagler

It is certified that error appears in the above-identified patent and that said Letters Patent is hereby corrected as shown below:

Column 3,
Line 51, after "It will" insert -- be --.
Line 56, before "passage" insert -- sound --.

Column 4,
Lines 19-20, delete "he sound passage endcap".
Line 36, replace "vent 16" with -- membrane --.

Signed and Sealed this

Twenty-third Day of April, 2002

*Attest:*

*Attesting Officer*

JAMES E. ROGAN
*Director of the United States Patent and Trademark Office*